United States Patent [19]

Simon

[11] Patent Number: 4,568,357

[45] Date of Patent: Feb. 4, 1986

[54] DIESEL FUEL COMPRISING CERIUM AND MANGANESE ADDITIVES FOR IMPROVED TRAP REGENERABILITY

[75] Inventor: Gerald M. Simon, West Bloomfield, Mich.

[73] Assignee: General Motors Corporation, Detroit, Mich.

[21] Appl. No.: 685,385

[22] Filed: Dec. 24, 1984

[51] Int. Cl.[4] ..... C10L 1/18

[52] U.S. Cl. ..... 44/57; 44/68

[58] Field of Search ..... 44/57, 68

[56] References Cited

U.S. PATENT DOCUMENTS

| | | | |
|---|---|---|---|
| 2,086,775 | 7/1937 | Lyons et al. | 44/68 |
| 2,460,700 | 2/1949 | Lyons | 44/68 |
| 2,546,421 | 3/1951 | Bartholomew et al. | 44/68 |
| 3,332,755 | 7/1967 | Kukin | 44/68 |

*Primary Examiner*—Y. Harris-Smith

*Attorney, Agent, or Firm*—Douglas D. Fekete

[57] ABSTRACT

An improved fuel for operating a diesel engine equipped with a particulate trap contains a combination of a cerium naphthenate additive and a manganese dioxide additive.

3 Claims, No Drawings

DIESEL FUEL COMPRISING CERIUM AND MANGANESE ADDITIVES FOR IMPROVED TRAP REGENERABILITY

BACKGROUND OF THE INVENTION

This invention relates to diesel fuel for an automotive diesel engine operated in combination with a ceramic trap for removing carbonaceous particulates from exhaust gases, which trap is periodically regenerated by burnoff of the collected material. More particularly, this invention relates to diesel fuel containing a cerium naphthenate additive and a manganese dioxide additive for introducing the metals into the particulates in a combination that is particularly effective to improve trap regenerability.

It has been proposed to filter exhaust gases from an automotive diesel engine to remove entrained carbonaceous particulates that are byproducts of the diesel combustion process and thereby reduce emissions of said particulates into the atmosphere. For this purpose, a ceramic trap is incorporated into the exhaust system onboard an automotive vehicle. The accumulation of particulate material within the trap increases the exhaust backpressure, which adversely affects engine performance. To reduce the backpressure, the collected material is periodically ignited and combusted, which regenerates the trap. Before igniting, it is necessary that the quantity of material be sufficient to sustain combustion. In general, increasing the quantity of accumulated material facilitates sustained combusion, but sacrifices engine performance because of increased exhaust backpressure. In addition, a heavier loading tends to produce a higher burnoff temperature and may damage the trap. Therefore, it is desired to reduce the loading required to sustain combustion and regenerate the trap.

It is known that the combustion of diesel particulates may be catalyzed by a metal such as manganese or lead. A compound of the metal is typically added to the fuel. During the engine combustion, the metal becomes dispersed into the particulates. The metal tends to reduce the ignition temperature and thereby promotes sustained combustion that regenerates the trap. Cerium has also been tested as a diesel fuel additive and was believed to behave similarly in reducing the particulate ignition temperature, although with different degrees of effectiveness. However, I have now found that addition of a combination of particular compounds of manganese and cerium substantially improves trap regenerability.

Therefore, it is an object of this invention to provide an improved diesel fuel for operating a diesel engine in combination with a trap for filtering particulates from exhaust gases, which fuel comprises a combination of a cerium additive and a manganese additive in amounts sufficient to enhance combustion of accumulated particulates and thereby promote regeneration of the trap. A surprising feature of this invention is that the combination of cerium and manganese additives decreases the quantity of particulate material required to sustain combustion after ignition to regenerate the trap. This reduces the maximum loading on the trap, thereby reducing the maximum exhaust pressure resulting therefrom and improving engine performance.

SUMMARY OF THE INVENTION

In accordance with a preferred embodiment of this invention, a diesel engine equipped with a ceramic particulate trap is operated with a hydrocarbonaceous fuel containing a cerium naphthenate additive and a manganese dioxide additive. The metallic compounds may be separately added to the fuel, or may be preblended and added to the fuel. The metallic compounds are preferably added in an amount sufficient to produce a concentration of between 0.02 and 0.13 gram per liter (0.075 and 0.5 gram per gallon) cerium and between 0.02 and 0.13 gram per liter (0.075 and 0.5 gram per gallon) manganese. During engine operation, manganese and cerium become dispersed in an active form into the byproduct particulates, which particulates are filtered onto the trap. When periodically the accumulation of particulate material is ignited, for example, using a glow plug, combustion of the material is readily sustained to regenerate the trap. It has been found that the combination of these manganese and cerium additives reduces the quantity of material necessary to sustain combustion and thus allows the trap to be regenerated after lighter loading.

DETAILED DESCRIPTION OF THE INVENTION

In a preferred embodiment, a cerium (III) naphthenate agent and a manganese dioxide agent were added to a standard diesel fuel. A solution of cerium (III) naphthenate dissolved in a hydrocarbon solvent was commercially obtained from Rhone-Poulenc, Inc., Monmouth Junction, N.J. This organometallic compound is believed to have been prepared by reacting a cerium compound with naphthenic acid. The solution contained about six percent by weight cerium. The manganese dioxide was commercially obtained as a xylene suspension from the Lubrizol Corporation, Wickliffe, Ohio, under the trade designation Lubrizol 8220. It is believed to comprise about 4.25 weight percent manganese in the form of manganese dioxide.

The effectiveness of the combination of manganese and cerium additives in improving trap regenerability was demonstrated in tests carried out using a 4.3L V-6 Oldsmobile diesel engine equipped with an exhaust system comprising a wall-flow ceramic particulate trap. The trap is formed of a gas-permeable ceramic material and comprises a plurality of longitudinal gas passages arranged in a honeycomb structure and extending between an upstream face and a downstream face. The ends of alternate passages are plugged at each face in a checkerboard pattern and such that opposite ends of adjacent passages are closed. Thus, exhaust gas entering a passage at the upstream face flows through the wall into an adjacent passage in order to exit from the downstream face. A glow plug is positioned in contact with the upstream face. During engine operation, the glow plug is intermittently electrically heated to ignite particulate material deposited onto the upstream face.

Tests were conducted as follows: The diesel engine was operated at 1240 revolutions per minute (rpm) under a load of 72 Newton-meters. This corresponds approximately to operation of a vehicle at 40 miles per hour. Gas pressure sensors were placed in the exhaust stream both upstream and downstream from the particulate trap to measure the pressure drop across the trap. As the trap collects particulates, the pressure drop across the trap increases. Delta pressure drop is defined as the increase in the pressure drop and indicates the quantity of particulate material that has accumulated upon the trap. After the delta pressure drop has achieved a predetermined value, the glow plug is heated to ignite the deposit. After sufficient time to permit trap regeneration, the pressure drop across the trap is measured and compared to the original value to determine the reduction in the delta pressure drop, which is indicative of the extent to which the trap is regenerated.

The following fuels were formulated by blending the additives into a base diesel fuel designated ASTM grade D2. Fuel 1 consisted of the base fuel plus sufficient cerium naphthenate to produce a cerium concentration of 0.024 gram per liter and sufficient manganese dioxide to produce a manganese concentration of 0.029 gram per liter. Fuel 2 consisted of the base fuel plus 0.071 gram per liter manganese added as manganese dioxide and 0.058 gram per liter cerium added as cerium naphthenate. For comparison, fuel 3 contained 0.061 gram per liter manganese added as manganese dioxide. Fuel 4 contained 0.063 gram per liter cerium added as cerium naphthenate. Fuel 5 contained 0.13 gram per liter cerium added as cerium naphthenate. The neat base fuel was not tested because previous experience had indicated that the trap was not regenerable in the absence of a fuel additive.

The results of the trap regenerability tests carried out under road load conditions are set forth in Table 1.

TABLE I

ROAD LOAD TRAP REGENERABILITY REPORTED AS PERCENTAGE REDUCTION IN DELTA PRESSURE DROP

| Pre-ignition Delta Pressure Drop in kPa | Fuel 1 | Fuel 2 | Fuel 3 | Fuel 4 | Fuel 5 |
|---|---|---|---|---|---|
| 10 | 1 | 51 | 1 | — | 27 |
| 12 | 73 | 62 | 32 | 3 | 69 |
| 14 | 78 | 89 | 42 | — | — |
| 16 | 91 | 90 | 83 | 78 | 90 |

As shown in the table, particularly for tests carried out at 12 kPa delta pressure drop, fuel 1 containing both the cerium and manganese additives performed substantially better than the manganese-only fuel 3 or the cerium-only fuel 4, despite approximately equivalent total metal concentrations. At the higher loading level indicated by a delta pressure drop of 16 kPa, fuels 1 and 2, containing both manganese and cerium additives, performed significantly better than fuels 3 and 4, containing the individual additives. However, at this heavier loading, combustion is more readily sustained and the effect of the additive is reduced. The combination of additives in this invention permits trap regeneration at reduced loading, for example, after a delta pressure drop of 14 kPa as opposed to 16 kPa.

A second set of tests was performed similar to the above test, except that trap regeneration was carried out under conditions corresponding approximately to idle vehicle operation. The trap was loaded while the engine was operated at 1240 rpm and a load of 72 Newton-meters. After the desired delta pressure drop was achieved, the engine was decelerated to 900 rpm and the load was reduced to 25 Newton-meters, corresponding approximately to idle operation. The glow plug is heated to ignite the deposit. After sufficient time to permit trap regeneration, the engine was accelerated to 1240 rpm and the load was increased to 72 Newton-meters. The pressure drop across the trap was measured and compared to the predeceleration value to determine the reduction in the delta pressure drop. This test procedure decreases the time required to load the trap by initially operating under road conditions, but regenerates the trap under idle conditions that include reduced exhaust temperature and flow. The engine is accelerated to make post-regeneration pressure measurements under conditions comparable to the pre-regeneration measurements.

The results of this test are shown in Table II.

TABLE II

IDLE TRAP REGENERABILITY REPORTED AS PERCENTAGE REDUCTION IN DELTA PRESSURE DROP

| Pre-ignition Delta Pressure Drop | Fuel 1 | Fuel 2 | Fuel 3 |
|---|---|---|---|
| 10 | 42 | 43 | 1 |
| 12 | 84 | 89 | 58 |
| 14 | 85 | 86 | 80 |

Diesel fuel containing a combination of cerium naphthenate and manganese dioxide in accordance with this invention permits trap regeneration after reduced loading. During engine operation, the carbonaceous particulates deposit onto the trap at the upstream face and along the surfaces of the numerous longitudinal passages that open at the upstream face. This deposit restricts gas flow through the trap and increases the exhaust backpressure. In order to regenerate the trap, it is necessary to clean the deposit not only from the upstream face, but also from the upstream passages. Accordingly, the deposit is ignited at a location on the upstream face and the flame front propagates into and along the passages. This requires that combustion be sustained after ignition. In the absence of sustained combustion, the burnoff is limited to the region on the upstream face that is ignited and the trap is not regenerated. Flame propagation of the type required to sustain combustion depends upon several factors. Although heavier deposits favor sustained combustion, it is desired to minimize the deposit on the trap to reduce the effect upon engine performance. Both cerium and manganese reduce the ignition temperature of the particulate material, which facilitates flame propagation. However, progressive combustion of the deposit is also affected by the flame temperature and the rate at which the flame propagates. It is believed that the combination of cerium and manganese influences, in a manner not fully understood, these factors affecting flame propagation and thereby allows combustion to be sustained despite a reduction in the quantity of material deposited onto the trap.

The cerium and manganese additives in accordance with this invention are blended with the hydrocarbonaceous base fuel prior to combustion of the fuel within the engine. During engine combustion, the metallic compounds may undergo reaction to active forms that are particularly effective to enhance combustion of carbonaceous particulates. The metals in active form become dispersed in the particulates as they form during the diesel combustion process. In addition to improving trap regenerability, the combination of the preferred additives may also reduce engine-out particulates and thereby extend the permissible interval between trap regenerations. Also, the incorporation of cerium with the manganese may lower the maximum combustion temperature during regeneration and thus reduce the tendency for damage to the trap. Further, the combustion of the accumulated particulate material upon the trap produces an ash, which ash accumulates over the life of the trap and restricts gas flow therethrough. The combination of cerium with manganese may increase the density of the ash and thereby extend the useful life of the trap.

For an automotive vehicle, the metallic agents may be contained in the fuel that is introduced into the fuel tank. Alternately, the additives may be blended into the base fuel onboard the vehicle. Although the agents may be added separately, it is desired that the additives be preblended into a single solution, particularly for on-board addition. It has been found that the combination of the preferred cerium naphthenate and the preferred manganese dioxide suspension forms a stable liquid particularly suitable for on-board addition.

While this invention has been described in terms of certain embodiments thereof, it is not intended that it be limited to the above description but rather only to the extent set forth in the claims that follow.

The embodiments of the invention in which an exclusive property or privilege is claimed are defined as follows:

1. A method for operating a diesel engine in combination with a ceramic trap for filtering carbonaceous particulates from exhaust gases emitted by said engine as a result of combustion of a liquid hydrocarbonaceous fuel, which trap is periodically regenerated by ignition and combustion of the particulate material accumulated thereon, said fuel comprising a cerium naphthenate agent and a manganese dioxide agent in proportions and amounts sufficient to enhance sustained combustion of the accumulated particulate material and thereby to promote trap regeneration.

2. A method for operating a diesel engine in combination with a wall-flow ceramic trap for filtering carbonaceous particulates from exhaust gases emitted by said engine as a result of combustion of a hydrocarbonaceous fuel, which trap is periodically regenerated by ignition and combustion of the particulate material accumulated thereon, said method comprising blending into the fuel prior to combustion a cerium naphthenate additive and a manganese dioxide additive in amounts sufficient to produce a concentration of between, about 0.02 and 0.13 gram per liter cerium added as cerium naphthenate and between about 0.02 and 0.13 gram per liter manganese added as manganese dioxide, whereby metallic compounds derived from said additives become dispersed in the particulates formed during engine combustion and enhance sustained combustion of the accumulated material on the trap for regeneration.

3. A diesel fuel for operating a diesel engine equipped with a ceramic trap for filtering carbonaceous particulates from exhaust gases produced thereby, said fuel being composed predominantly of a liquid hydrocarbonaceous composition suitable for combustion within said diesel engine and which produces exhaust gases having entrained carbonaceous particulates, said fuel comprising a cerium naphthenate additive in an amount sufficient to produce a cerium concentration between about 0.02 and 1.3 gram per liter and a manganese dioxide additive in an amount sufficient to produce a manganese concentration between about 0.02 and 0.13 gram per liter, said cerium naphthenate additive and said manganese dioxide additive being present in a combination effective to produce during engine operation metallic compounds dispersed in said carbonaceous particulates that enhance sustained combustion of particulate material accumulated upon the trap to promote trap regeneration.

* * * * *